US011000127B1

(12) United States Patent
Wu et al.

(10) Patent No.: US 11,000,127 B1
(45) Date of Patent: May 11, 2021

(54) ARMREST DEVICE FOR ADJUSTING INCLINATION ANGLE OF BACKREST

(71) Applicant: NINGBO KAIMENG ELECTRONIC TECHNOLOGY CO., LTD., Ningbo (CN)

(72) Inventors: Haiquan Wu, Huzhou (CN); Jingwen Chen, Foshan (CN)

(73) Assignee: NINGBO KAIMENG ELECTRONIC TECHNOLOGY CO., LTD., Ningbo (CN)

( * ) Notice: Subject to any disclaimer, the term of this patent is extended or adjusted under 35 U.S.C. 154(b) by 0 days.

(21) Appl. No.: 17/096,926

(22) Filed: Nov. 12, 2020

(30) Foreign Application Priority Data

Dec. 17, 2019 (CN) ..... 201922268764.X

(51) Int. Cl.
*A47C 1/02* (2006.01)
*A47C 1/024* (2006.01)
*A47C 7/34* (2006.01)
*A47C 1/032* (2006.01)

(52) U.S. Cl.
CPC ..... *A47C 1/024* (2013.01); *A47C 1/03272* (2013.01); *A47C 7/34* (2013.01)

(58) Field of Classification Search
CPC ..... A47C 1/024; A47C 1/03272; A47C 7/34; A47C 1/14; A47C 1/0265; A47C 1/03244
See application file for complete search history.

(56) References Cited

U.S. PATENT DOCUMENTS

| | | | | |
|---|---|---|---|---|
| 4,072,341 | A * | 2/1978 | Kurz | A47C 1/035 267/179 |
| 6,382,727 | B1 * | 5/2002 | Pickard | A47C 7/506 297/30 |
| 6,692,068 | B1 * | 2/2004 | Tang | A47C 1/035 297/16.2 |
| 6,755,463 | B2 * | 6/2004 | Lardieri | A47C 1/03 297/35 |
| 8,864,220 | B2 * | 10/2014 | Kim | A47C 1/0342 297/19 |
| 2002/0121800 | A1 * | 9/2002 | Yu | A47C 1/0265 297/27 |
| 2007/0145792 | A1 * | 6/2007 | Miller | A47C 7/66 297/184.1 |
| 2020/0383481 | A1 * | 12/2020 | Cieszko | A47C 4/20 |

* cited by examiner

*Primary Examiner* — Philip F Gabler

(57) ABSTRACT

An armrest device for adjusting an inclination angle of a backrest. The armrest device includes a side connecting bracket and an armrest. A lower end of the side connecting bracket is fixedly connected with a seat cushion. Right ends of the side connecting bracket and the armrest are rotatably connected with the backrest. An upper end of the side connecting bracket is fixedly connected with a positioning seat. An upper end of the positioning seat extends to an inner cavity of the armrest. The positioning seat shifts the inclination angle of the backrest and limits a position of the backrest through a positioning mechanism. A first spring limiting a movement of the armrest in an X direction and a second spring limiting a movement of the armrest in a Z direction are disposed between the positioning seat and the armrest.

6 Claims, 5 Drawing Sheets

ARMREST DEVICE FOR ADJUSTING INCLINATION ANGLE OF BACKREST

TECHNICAL FIELD

The present disclosure relates to a field of adjusting device technology, and in particular to an armrest device for adjusting an inclination angle of a backrest.

BACKGROUND

An office chair generally comprises armrests and a backrest that is able to be inclined, which is convenient for a user to sit on during work and rest after work. The armrests and the backrest generally move synchronously. When the armrests are inclined backward, the backrest inclined backward along with the armrests. However, conventional adjusting methods of the backrest on the market are to first press an adjusting button to release the armrests from the fixed state, so that the armrests are switched from the fixed state to a movable and adjustable state. However, in this type of method, the user needs to pull the armrests backward while press the adjusting button by his hand during the adjustment process, and then the user needs to use the inclined force given by the back to realize the backrest to incline, which is inconvenient to operate.

SUMMARY

The present disclosure aims to solve the above-mentioned defects of the prior art and provides an easy-to-use armrest device for adjusting inclination of a backrest, which realizes quick adjustment of an inclination angle of the backrest by the armrest. A user is able to adjust the inclination angle of the backrest according to actual needs, which is convenient and fast.

The technical scheme adopted by the present disclosure to solve the technical problems is to provide an armrest device for adjusting an inclination angle of a backrest. The armrest device comprises a side connecting bracket and an armrest. A lower end of the side connecting bracket is fixedly connected with a seat cushion of a chair. A right end of the side connecting bracket and a right end of the armrest are rotatably connected with the backrest of the chair. An upper end of the side connecting bracket is fixedly connected with a positioning seat. An upper end of the positioning seat extends to an inner cavity of the armrest. The positioning seat shifts the inclination angle of the backrest and limits a position of the backrest through a positioning mechanism disposed in the inner cavity of the armrest. A first spring limiting a movement of the armrest in an X direction and a second spring limiting a movement of the armrest in a Z direction are disposed between the positioning seat and the armrest. One end of the first spring is connected with the positioning seat through a first connecting structure. Another end of the first spring is connected with the armrest through a second connecting structure. One end of the second spring is connected with the positioning seat through a third connecting structure. Another end of the second spring is connected with the armrest through a fourth connecting structure. Through the positioning mechanism, the armrest quickly realizes an adjustment of the armrest while quickly determines the inclination angle of the backrest. The first spring and the second spring are arranged along the X and Z directions. The first spring in the X direction is configured to connect and limit the fixing seat and the backrest, as well as pull the armrest. On one hand, when the backrest is inclined backward, elasticity of the first spring slows down a speed of the backrest to prevent the backrest from tilting to the end, so as not to frighten the user. On the other hand, a self-returning property of the first spring realizes quick return of the backrest when returning. The second spring in the Z direction is configured to connect and limit the fixing seat and the armrest, so that a lifting height of the armrest is limited, and after the fixing seat is lowered. The self-reset property of the second spring drives the armrest down quickly, so as to quickly determine the inclination angle of the backrest, which is convenient and quick, and the effect is good.

Furthermore, the positioning mechanism comprises a positioning bayonet inserted into the positioning seat and positioning groove groups fixedly disposed on the inner cavity of the armrest. The positioning groove groups are front-and-rear symmetrical arranged. The positioning groove groups are disposed on an inner wall of the inner cavity of the armrest. Two ends of the positioning bayonet are respectively clamped in the positioning groove groups. Structures of the positioning bayonet and the positioning groove groups are simple, and matching effect is good. The positioning bayonet is inserted into the positioning groove groups and is engaged with the positioning groove groups. The positioning groove groups are front-and-rear symmetrical arranged, such that the positioning bayonet is inserted and is fixed between two positioning groove groups after insertion, which makes the whole positioning mechanism stable and good in use.

Furthermore, each of the positioning groove groups comprises a row of fixing blocks disposed from left to right at intervals. An interval between two adjacent fixing blocks forms a positioning groove. Two end of the positioning groove are closed, such an arrangement limits the positioning bayonet in the positioning groove. That is, an outer end surface of the positioning bayonet is attached to the inner wall of the inner cavity of the armrest. During use, the positioning bayonet quickly enters the positioning groove and does 1 not produce a sense of obstruction.

Furthermore, a fixing block on a far left and a fixing block on a far right are limiting blocks, which are configured to limits an adjusting distance of the armrest, so as to limit the inclination angle of the backrest.

Furthermore, the first connecting structure is a first pulling hook and the second connecting structure is a second pulling hook. The one end of the first spring is connected to the first pulling hook. The another end of the first spring is connected to the second pulling hook. The first pulling hook is connected to the positioning seat along the X direction. The second pulling hook is connected to an inner wall of the armrest along the X direction. In this way, two ends of the first spring are hooked on the first pulling hook and the second pulling hook. The structure is simple and the operation is convenient. Moreover, the role of the first spring is played during use.

Furthermore, the third connecting structure is a third pulling hook and the fourth connecting structure is a fourth pulling hook. The one end of the second spring is connected to the third pulling hook. The another end of the second spring is connected to the fourth pulling hook. The third pulling hook is connected to the positioning seat along the Z direction. The fourth pulling hook is connected to an inner wall of the armrest along the Z direction. In this way, two ends of the second spring are hooked on the third pulling hook and the fourth pulling hook. The structure is simple and the operation is convenient. Moreover, the role of the first spring is played during use.

The armrest device for adjusting the inclination angle of the backrest of the present disclosure not only shifts and determines the inclination angle of the backrest, but also limits the position of the armrest. On the one hand, it prevents the backrest from continuing to tilt backward due to too slow positioning limitation, which poses a safety hazard during use. On the other hand, when the backrest is retracted, the backrest is quickly returned to original position. Further, the overall structure is simple, easy to operate, and worthy of promotion.

1—side connecting bracket; 2—armrest; 3—positioning seat; 4—positioning mechanism; 5—first spring; 6—second spring; 7—positioning bayonet; 8—positioning groove group; 9—fixing block; 10—positioning groove; 11—first pulling hook; 12—second pulling hook; 13—third pulling hook; and 14—fourth pulling hook.

DETAILED DESCRIPTION

Figure 1:
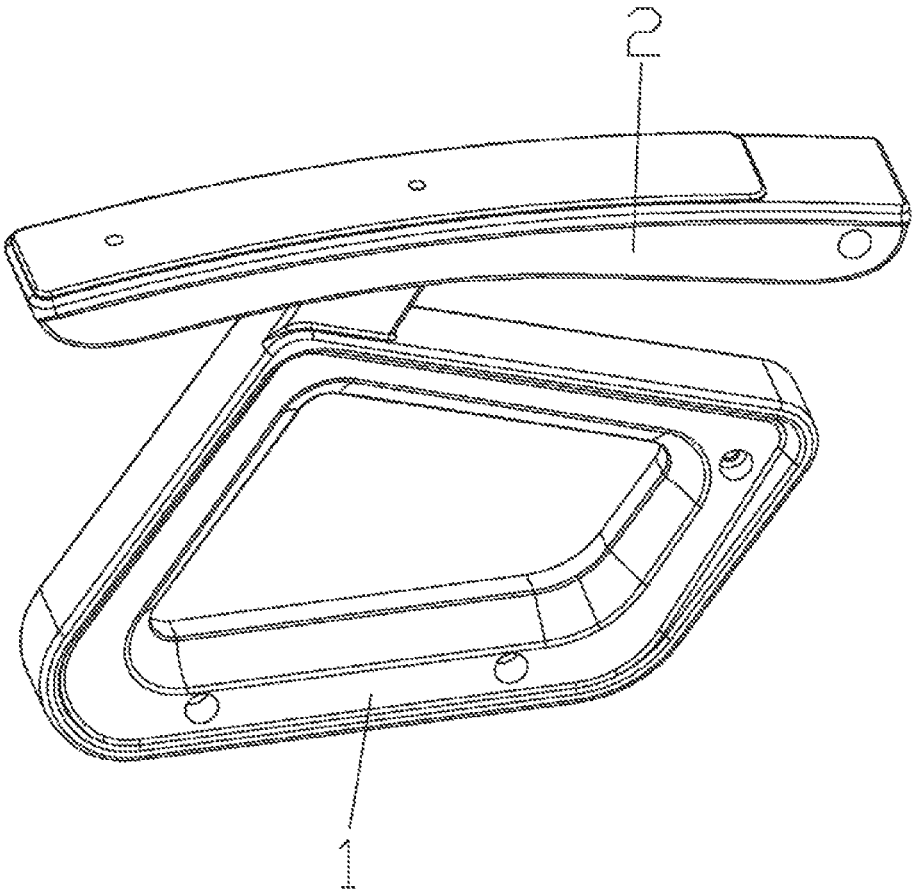
FIG. 1 is a perspective schematic diagram showing a structure of an armrest device of the present disclosure.
Figure 2:
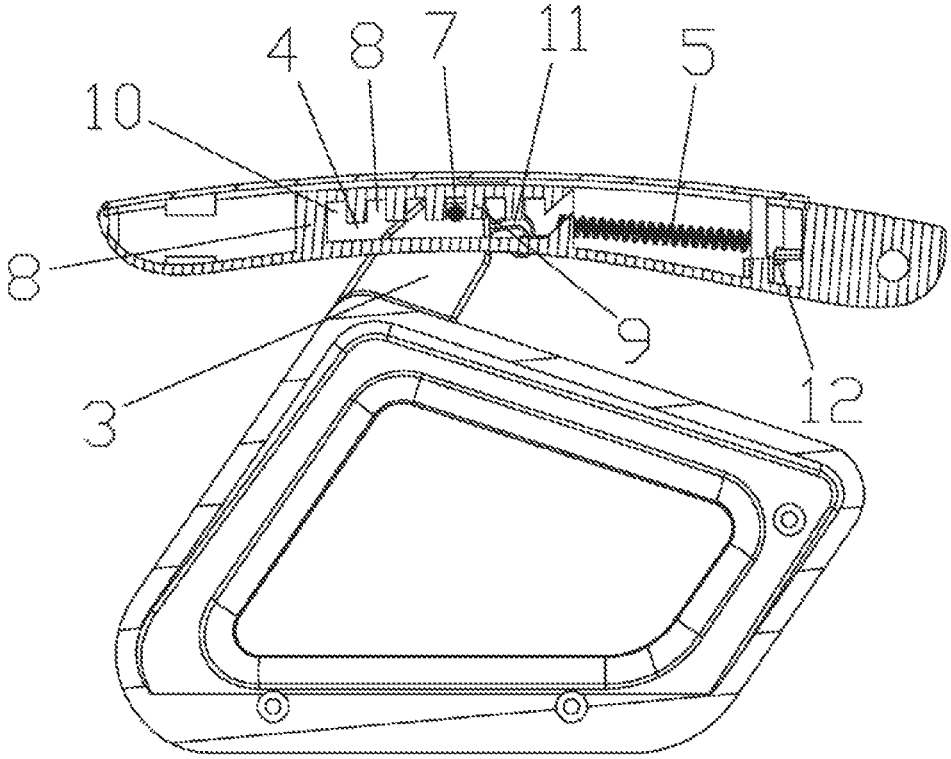
FIG. 2 is a front cross-sectional schematic diagram showing the structure of the armrest device the present disclosure.
Figure 3:
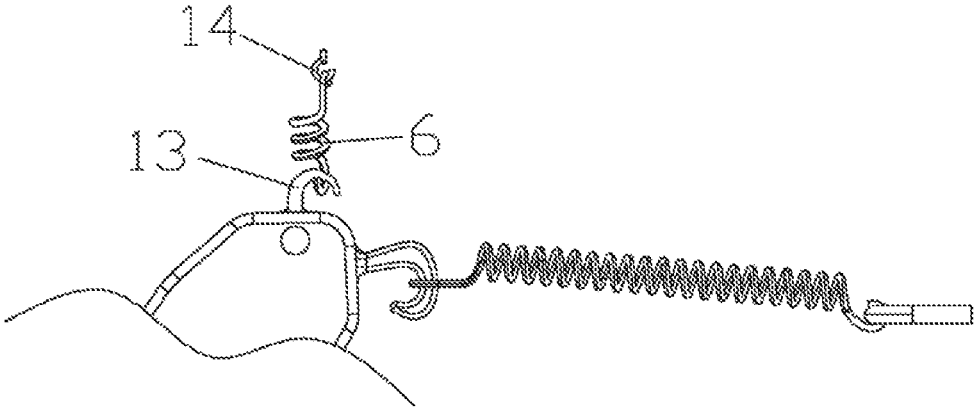
FIG. 3 is an enlarged partial view showing the positioning seat connected with the second spring.
Figure 4:
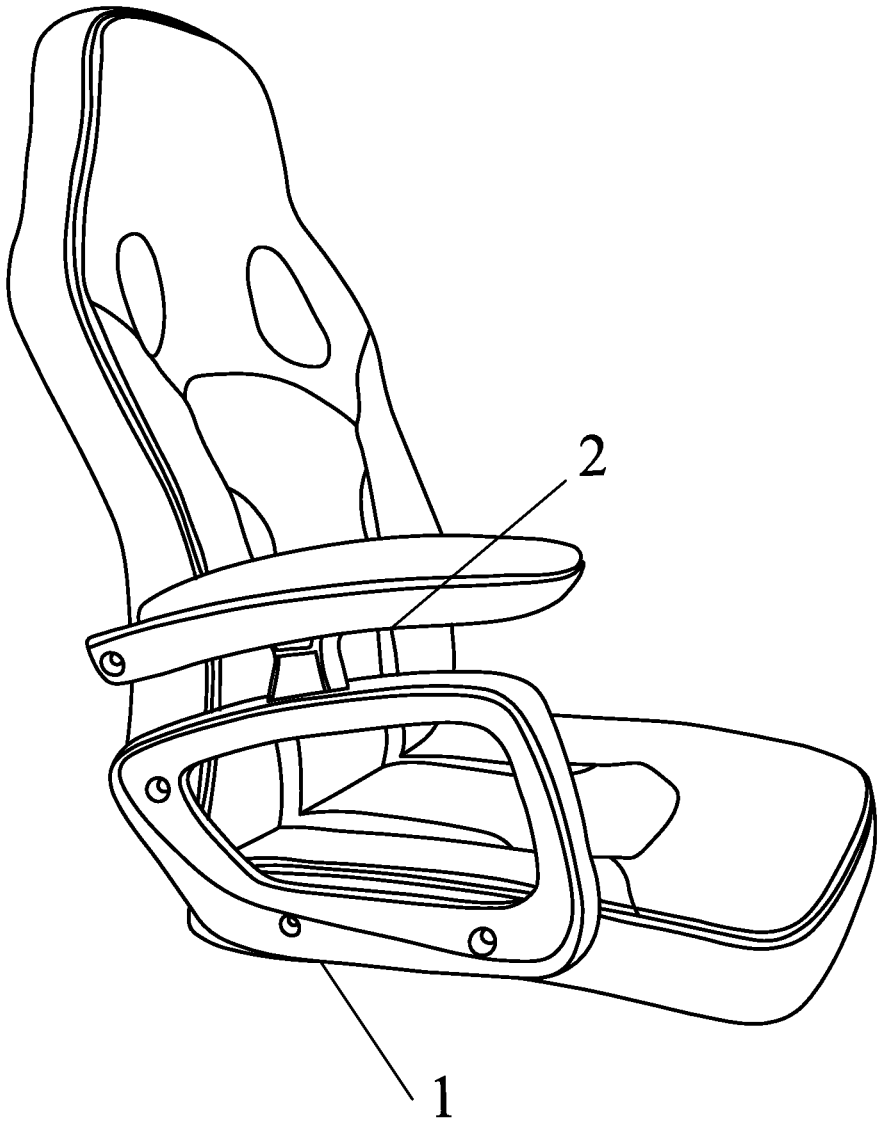
FIG. 4 is a perspective schematic diagram of the armrest device where the armrest device is in a first configuration of use.
Figure 5:
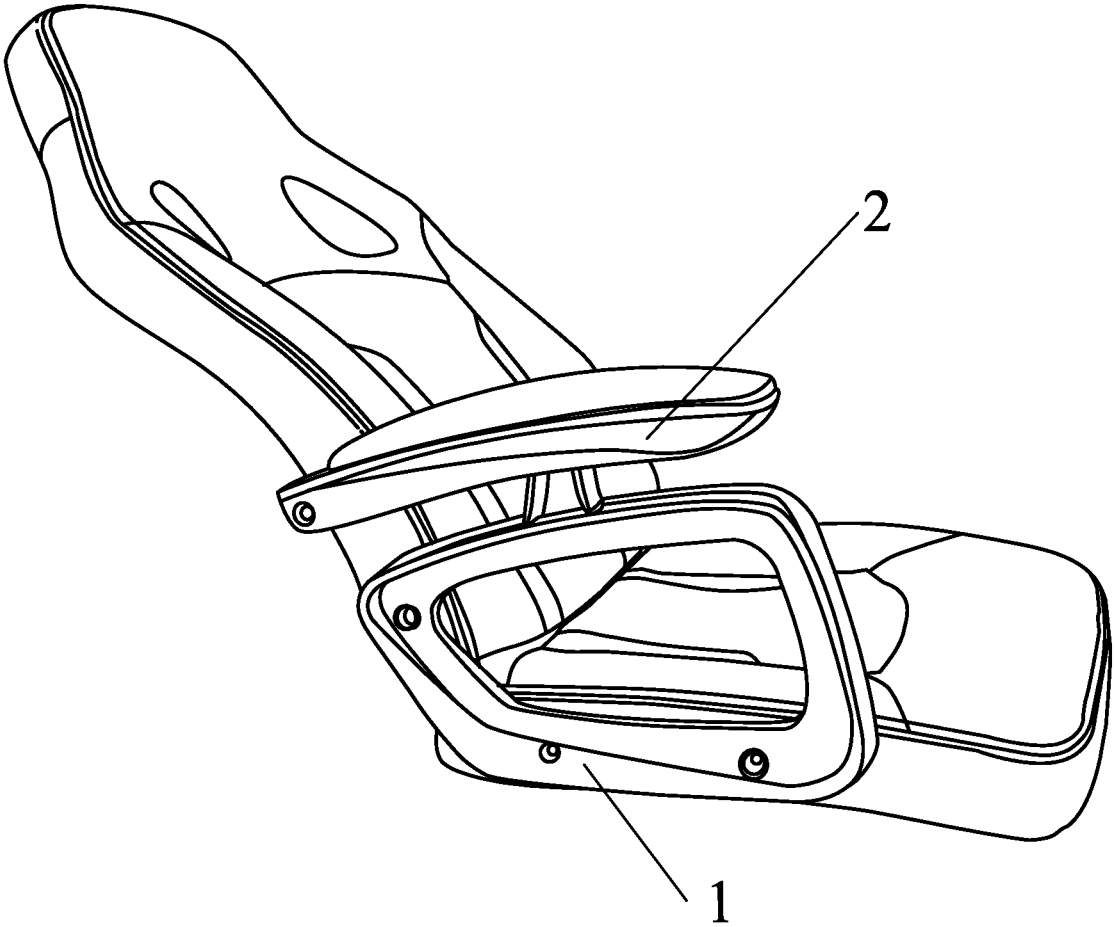
FIG. 5 is a perspective schematic diagram of the armrest device where the armrest device is in a second configuration of use.

The present disclosure will be further explained below in conjunction with the drawings:

As shown in FIGS. 1-5, the present disclosure provides an armrest device for adjusting an inclination angle of a backrest. The armrest device comprises a side connecting bracket 1 and an armrest 2. A lower end of the side connecting bracket 1 is fixedly connected with a seat cushion of a chair. A right end of the side connecting bracket 1 and a right end of the armrest 2 are rotatably connected with the backrest of the chair. An upper end of the side connecting bracket 1 is fixedly connected with a positioning seat 3. An upper end of the positioning seat 3 extends to an inner cavity of the armrest 2. The positioning seat 3 shifts the inclination angle of the backrest and limits a position of the backrest through a positioning mechanism 4 disposed in the inner cavity of the armrest 2. A first spring 5 limiting a movement of the armrest 2 in an X direction and a second spring 6 limiting a movement of the armrest 2 in a Z direction, are disposed between the positioning seat 3 and the armrest 2. One end of the first spring 5 is connected with the positioning seat 3 through a first pulling hook. Another end of the first spring 5 is connected with the armrest through a second pulling hook. One end of the second spring 6 is connected with the positioning seat 3 through a third pulling hook. Another end of the second spring 6 is connected with the armrest 2 through a fourth pulling hook.

The positioning mechanism 4 comprises a positioning bayonet 7 inserted into the positioning seat 3 and positioning groove groups 8 fixedly disposed on the inner cavity of the armrest 2. The positioning groove groups 8 are front-and-rear symmetrical arranged. The positioning groove groups 8 are disposed on an inner wall of the inner cavity of the armrest 2. Two ends of the positioning bayonet 7 are respectively clamped in the positioning groove groups 8.

Furthermore, each of the positioning groove groups 8 comprises a row of fixing blocks 9 disposed from left to right at intervals. An interval between two adjacent fixing blocks forms a positioning groove 10.

A fixing block 9 on a far left and a fixing block 9 on a far right are limiting blocks.

The one end of the first spring 5 is connected to the first pulling hook 11. The another end of the first spring is connected to the second pulling hook 12. The first pulling hook 11 is connected to the positioning seat 3 along the X direction. The second pulling hook 12 is connected to an inner wall of the armrest 2 along the X direction.

The one end of the second spring 6 is connected to the third pulling hook 13. The another end of the second spring is connected to the fourth pulling hook 14. The third pulling hook 13 is connected to the positioning seat 3 along the Z direction. The fourth pulling hook 14 is connected to an inner wall of the armrest 2 along the Z direction.

When in use, the armrest 2 is lifted up so that the positioning bayonet 7 is separated from the positioning groove 10. Then the armrest 2 moves backward in the X direction. One end of the armrest 2 is rotatably connected with the backrest, as a distance that the armrest 2 moves backward increases, the backrest gradually tilts backward. When the backrest is in an initial unchanged state, the backrest is 90° perpendicular to the seat cushion, and the positioning bayonet 7 enters a first positioning groove 10 from right to left. When inclined backward by 20°, the positioning bayonet 7 enters a second positioning slot 10 from right to left. When the positioning bayonet 7 is in the second positioning slot 10, the backrest is inclined 20 degrees backward, and the user can lean back on the backrest. When adjusting the inclination angle of the backrest, a user is able to insert the positioning bayonet into different positioning grooves 10. If the positioning bayonet disposed is changed to be inserted into an adjacent left positioning groove, the backrest should be inclined backward by 20°. When the positioning bayonet moves to the last positioning groove 10, the user can lie on the backrest, which helps the user to relax after sitting for a long time.

Meanwhile, under an elasticity of the first spring 5, the armrest 2 slows down a speed of the backrest tilting backward, and the two ends of the first spring 2 are connected with the first pulling hooks 11 and the second pulling hook 12. Under an elasticity of the second spring 6, the armrest 2 are accelerated to fall, so that the positioning bayonet 7 quickly enters the positioning groove 10, and the backrest is positioned quickly. Thus, the backrest is positioned quickly, preventing an occurrence of the situation where the backrest is still inclined backward due to lack of positioning, which has a good use effect.

Although the present disclosure has been illustrated and described with reference to the optional embodiments, those of ordinary skill in the art should understand that various changes in form and details can be made within the scope of the present disclosure.

What is claimed is:

1. An armrest device for adjusting an inclination angle of a backrest, comprising:

a side connecting bracket, and an armrest;

wherein a right end of the side connecting bracket and a right end of the armrest are rotatably connected with the backrest; an upper end of the side connecting bracket is fixedly connected with a positioning seat; an upper end of the positioning seat extends to an inner cavity of the armrest; the positioning seat shifts the inclination angle of the backrest and limits a position of the backrest through a positioning mechanism disposed in the inner cavity of the armrest; a first spring limiting a movement of the armrest in an X direction and a second spring limiting a movement of the armrest in a Z direction are disposed between the positioning seat and the armrest; one end of the first spring is connected with the positioning seat through a first connecting structure; another end of the first spring is connected with the armrest through a second connecting structure; one end of the second spring is connected with the positioning seat through a third connecting structure; another end of the second spring is connected with the armrest through a fourth connecting structure.

2. The armrest device for adjusting the inclination angle of the backrest according to claim 1, wherein the positioning mechanism comprises a positioning bayonet inserted into the positioning seat and positioning groove groups fixedly disposed on the inner cavity of the armrest; the positioning groove groups are symmetrical about a front-to-rear plane; the positioning groove groups are disposed on an inner wall of the inner cavity of the armrest; two ends of the positioning bayonet are respectively clamped in the positioning groove groups.

3. The armrest device for adjusting the inclination angle of the backrest groups a according to claim 2, wherein each of the positioning groove groups comprises a row of fixing blocks disposed from left to right at intervals; and an interval between two adjacent fixing blocks forms a positioning groove.

4. The armrest device for adjusting the inclination angle of the backrest according to claim 3, wherein a fixing block on a far left and a fixing block on a far right are limiting blocks.

5. The armrest device for adjusting the inclination angle of the backrest according to claim 1, wherein the first connecting structure is a first pulling hook; the second connecting structure is a second pulling hook; the one end of the first spring is connected to the first pulling hook; the another end of the first spring is connected to the second pulling hook; the first pulling hook is connected to the positioning seat along the X direction; the second pulling hook is connected to an inner wall of the armrest along the X direction.

6. The armrest device for adjusting the inclination angle of the backrest according to claim 1, wherein third connecting structure is a third pulling hook; the fourth connecting structure is a fourth pulling hook; the one end of the second spring is connected to the third pulling hook; the another end of the second spring is connected to the fourth pulling hook; the third pulling hook is connected to the positioning seat along the Z direction; the fourth pulling hook is connected to an inner wall of the armrest along the Z direction.

* * * * *